United States Patent [19]

Messinger et al.

[11] Patent Number: 4,742,965

[45] Date of Patent: May 10, 1988

[54] HYDROTHERAPY FITTING ASSEMBLY

[75] Inventors: Robert Messinger, Cranford; Samuel J. Tobias, Edison, both of N.J.

[73] Assignee: Hayward Pool Products, Inc., Elizabeth, N.J.

[21] Appl. No.: 907,960

[22] Filed: Sep. 16, 1986

Related U.S. Application Data

[63] Continuation of Ser. No. 668,523, Nov. 5, 1984, abandoned.

[51] Int. Cl.[4] ..... A61H 9/00

[52] U.S. Cl. ..... 239/417.3; 239/579; 239/587

[58] Field of Search ..... 239/401, 416, 416.4, 239/434.5, 428.5, 438, 579, 417.3, 417.5, 600, 587; 137/892, 899

[56] References Cited

U.S. PATENT DOCUMENTS

| | | | |
|---|---|---|---|
| 2,642,813 | 6/1953 | Woodruff et al. | 417/187 X |
| 3,391,870 | 7/1968 | Nash | 239/417.5 |
| 3,504,702 | 4/1970 | Collins et al. | 137/892 X |
| 4,261,347 | 4/1981 | Spencer et al. | 239/428.5 X |
| 4,335,854 | 6/1982 | Reynoso | 239/428.5 |

*Primary Examiner*—Andres Kashnikow

*Assistant Examiner*—Kevin Patrick Weldon

[57] ABSTRACT

A hydrotherapy fitting assembly is provided, featuring: an axial nozzle socket and a nozzle therein, receiving an axial flow of water and air, and projecting them in admixture from the housing as a jet stream; the nozzle comprising two pieces threadably and fixedly linked together for pivoting and rotating movement together in the socket; a cylindrical housing piece defining a central chamber; a cylindrical plug valve piece having an axial water inlet at one end an axial water outlet at the other end, threadably mounted in the control chamber, and movable axially on the threads in the central chamber of the cylindrical housing between limiting positions extending across and closing off the side water inlets, and fully exposing and opening the side water inlets, with intermediate positions partially exposing and opening the side water inlets; and leaving the air inlet exposed and open in both limiting positions of the valve; and constraining water flow therethrough first in an axial direction, then in a direction at an angle thereto, and then again an axial direction, and thereby in an S-curved path; the cylindrical plug valve piece having a nozzle portion defining the axial water jet outlet of the plug valve piece and projecting mixed air and water from the nozzle mixing chamber.

3 Claims, 4 Drawing Sheets

HYDROTHERAPY FITTING ASSEMBLY

This is a continuation of application Ser. No. 668,523, filed Nov. 5, 1984, now abandoned.

Hydrotherapy spas, tanks and pools are normally provided with hydrotherapy jet fittings that project a jet of water and air into the water. Such assemblies are customarily recessed in the wall of the spa, tank or pool, and include a nozzle which receives both air and water, mixes them, and projects them as a jet stream into the water in the spa, tank or pool.

One type of hydroair jet head assembly is described in U.S. Pat. No. 3,540,438, patented Nov. 17, 1970, to Jacuzzi. The jet head assembly includes a recessed housing having an inner end terminating in a wall structure formed to provide a hemispherical socket, with a water flow passageway for a water line and an air flow passageway for an air intake tube, both passageways leading to the socket, and thence to the nozzle assembly. The nozzle assembly has a ball end which fits in the socket, in which it is retained by a retaining ring, removably affixed to the rear wall of the housing by screws. A seal 21 between the retaining end and the ball end of the nozzle assembly permits angular adjustment of the nozzle assembly, while precluding leakage. The nozzle has an open axial passageway, and there is a valve seat engaged by the end of the nozzle exposing an annular passage in the open position of the nozzle and seating against the valve seat, thus plugging the open end, in the closed position of the nozzle. The specific details of design of the nozzle assembly are not a part of the invention of U.S. Pat. No. 3,540,438, but are shown in U.S. Pat. Nos. 3,273,560 patented Sept. 20, 1966 to Jacuzzi, and 3,297,025 patented Jan. 10, 1967 to Jacuzzi.

Jacuzzi U.S. Pat. No. 3,273,560 shows a structure very similar to that shown in the drawings of U.S. Pat. No. 3,540,438. As explained in column 2, in reference to FIG. 2, the nozzle member is threadably mounted in the member 48 for movement towards and away from the valve seat 60, and thus provides control of water flow,-water passing through the adjustable annular opening between the valve seat 60 and the nozzle 62. U.S. Pat. No. 3,354,730 shows a structure of the same type.

An annular valve opening closed off by a poppet-type valve plug can lead to problems in use. Wear of the bearing parts can be expected, resulting in leakage. Debris can lodge in the annular opening, and make it difficult or impossible to close or open the valve.

Another design provides for an adjustable nozzle mounted in a bowl mounting, movable independently of the nozzle for adjustment in water flow. In this type of structure, the nozzle cannot be moved angularly over as wide an arc as in the ball structure of the Jacuzzi patents discussed above. Typical of this design is U.S. Pat. No. 4,335,854, patented June 22, 1982 to Reynoso. The nozzle is referred to as a "eyeball" type nozzle, and it is rotatably mounted in the ball joint for sealing. Other patents showing this sort of design are Reynoso U.S. Pat. No. 4,416,030; Lloyd U.S. Pat. No. 3,336,921; Nash U.S. Pat. No. 3,391,870: Moreland U.S. Pat. No. 4,264,039; and Leggett U.S. Pat. No. 4,379,097.

Another design of fitting has the nozzle rotatable in a ball socket, with control of flow through the nozzle by way of a member bearing against a valve seat, but with the shape and size of the annular opening modified as the fitting is rotated. Exemplifying this type are U.S. Pat. No. 3,905,358 to Jacuzzi; No. 4,082,091 to Raab; No. 4,168,705 to Raab; No. 4,261,347 to Spencer; and No. 4,442,191 to Jaworski.

Kane U.S. Pat. No. 3,745,994 and Leggett U.S. Pat. No. 4,379,097 show another design in which the nozzle is not adjustable directionally.

In accordance with the present invention, a nozzle design is provided incorporating a cylindrical plug valve movable axially across side water inlets in a side wall of the valve chamber, the cylindrical plug valve according to its axial position either closing off the side water inlets by bearing against an end wall of the central valve chamber as a valve seat, or exposing and opening the side wall water inlets. The water flow is thus controlled by controlling the amount of exposure of the water inlets by the axial position of the cylindrical plug valve. There is accordingly no wear of bearing parts at the valve opening, and no way for debris to lodge in the water openings, and make it impossible to move the valve.

The hydrotherapy fitting assembly in accordance with the invention comprises, in combination, (1) a housing having:
  (a) a water inlet;
  (b) an air inlet; and
  (c) a socket for reception of a nozzle in fluid flow connection with the water inlet and the air inlet;
(2) a nozzle in the socket receiving water from the water inlet and air from the air inlet, and projecting them in admixture from the housing as a jet stream;
(3) the nozzle comprising:
  (a) a cylindrical housing defining a central chamber having a cylindrical wall and an end wall constituting a valve seat, and a plurality of water inlets in the side wall adjacent the end wall, and at least one air inlet in the side wall at a central portion thereof; and
  (b) a cylindrical plug valve movable axially in the central chamber between limiting positions extending across and closing off the side water inlets, and exposing and opening the side water inlets; and leaving the air inlet exposed and open in both limiting positions of the valve; the plug valve having a through axial passage with an axial inlet at one end, for entry of water from the side water inlets in the open position of the valve, and in the closed position of the valve when against the end wall valve seat closing off the axial water inlet; and an axial aspirating water outlet at the other end;
  (c) an axial air inlet at the outer periphery of the axial water outlet;
  (d) a nozzle mixing chamber receiving air from the axial air inlet and water from the axial aspirating water outlet; and
  (e) a jet nozzle projecting air and water from the nozzle mixing chamber.

In a preferred embodiment, the nozzle housing exterior is spherical, and mounted in the fitting assembly housing socket for angular movement among a plurality of radially-extending positions, and the cylindrical plug valve is threadably mounted in the central chamber of the nozzle housing.

The hydrotherapy fitting assembly according to the invention is illustrated in the drawings, in which.

Figure 1:
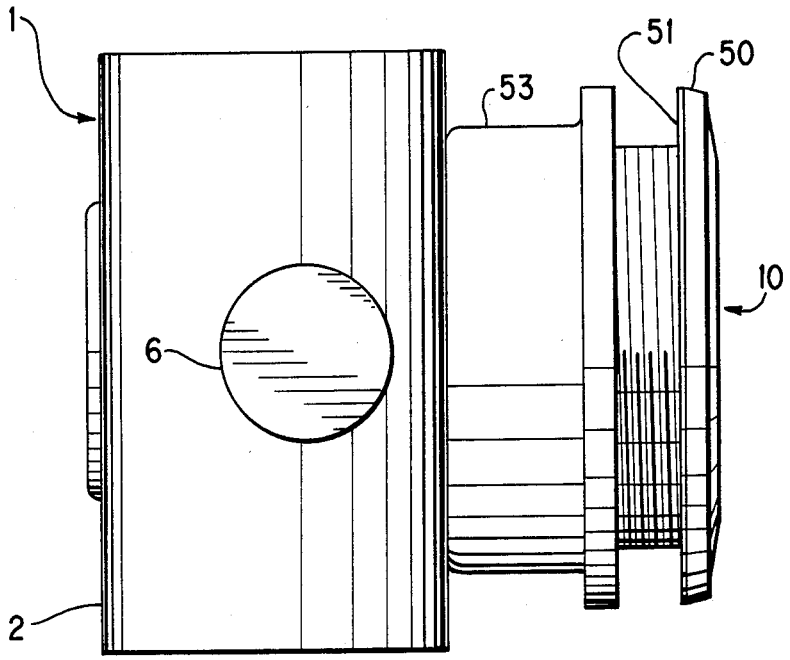
FIG. 1 represents a top view of one embodiment of a hydrotherapy fitting assembly according to the invention.
Figure 2:
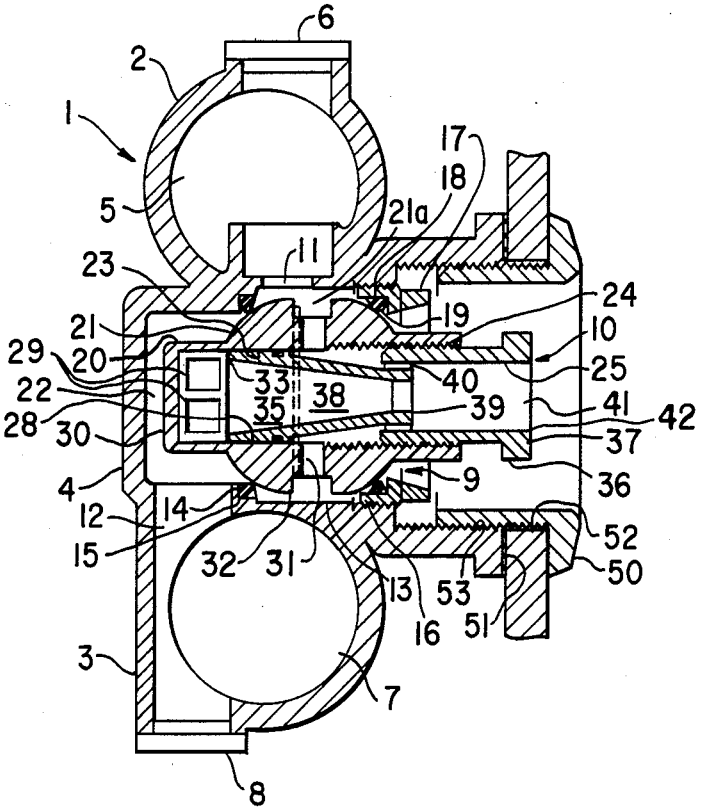
FIG. 2 represents an axial section of the hydrotherapy fitting asembly of FIG. 1.
Figure 3:
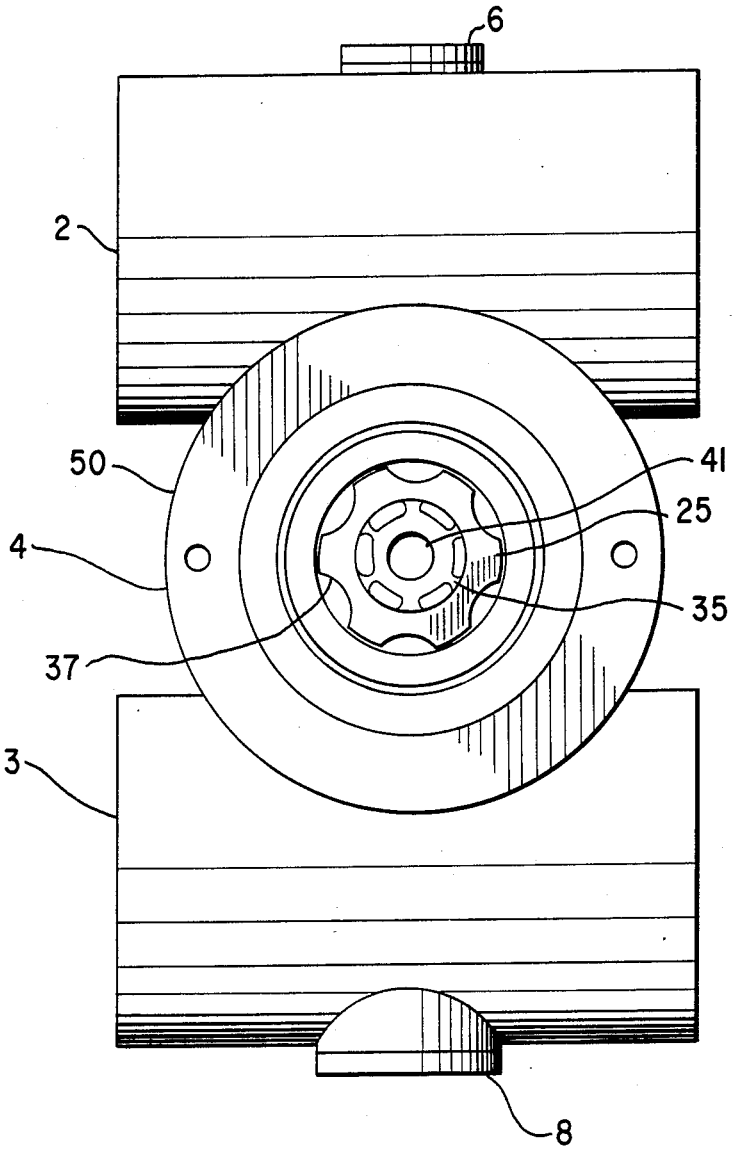
FIG. 3 represents a side view of the hydrotherapy fitting assembly of FIG. 1.

The hydrotherapy fitting assembly shown in FIGS. 1 to 3 includes a housing 1 in three interconnecting generally cylindrical portions 2,3,4, portion 2 defining an air chamber 5 with an air inlet 6 and portion 3 defining a water chamber 7 with a water inlet 8, the central portion 4 defining a socket 9 for the nozzle assembly 10. As best seen in FIG. 2, a passage 11 communicates the air chamber 5 with the nozzle socket 9, and a passage 12 communicates the water chamber 7 with the nozzle socket 9. The nozzle socket 9 has an enlarged portion 13 with a ledge 14 for reception of a seal ring 15, and a threaded portion 16 receiving a lock ring 17, which includes a ledge 18 for reception of a seal ring 19. The nozzle housing 20 which is spherical at 21 is retained in the socket by the lock ring, and sealing is assured by the seal rings 15 and 19, thus preventing passage of air from the portion 26 of the socket and passage of water from the portion 22 of the socket, with which the air passage 11 and water passage 12, respectively, are in fluid-flow communication.

The nozzle housing 20 is generally cylindrical except for the spherical portion 21, and defines a cylindrical socket 23 threaded at one end 24 for reception of the nozzle 25. The socket 23 has a cylindrical side wall 28 and a plurality of water inlets 29 in the side wall adjacent the end wall 30, and at least one air inlet 31 in the side wall at a central portion 32 thereof. The nozzle 25 is threadably mounted on the threads 24 of chamber 27 for axial movement towards and away from the end wall 30, which serve as a valve seat. The nozzle 25 has a through axial water flow passage 35, and thus constitutes a cylindrical plug valve that is movable axially on the threads 24 between limiting positions , the fully open position as shown in FIG. 2, with the inlets 29 fully exposed and open; and the fully closed position, with the end 33 of the nozzle seating against the end wall 30, the valve seat, thus closing off water flow from the inlets 29 into the axial through passage 35 of the nozzle. The outer end 36 of the nozzle includes a number of finger grips 37 for angular rotation of the nozzle on the threads 24 between the limiting open and closed positions of the valve, and any selected position in between.

The axial through passage 35 is constricted at the central portion 38, defining an aspirating outlet 39, and the valve housing 26 defines an annular air inlet 40 surrounding the periphery of the outlet 39, so that flow water through the outlet aspirates air via inlet 40 into the mixing chamber 41 of the nozzle, into which both the air inlet and the aspirating water outlet feed.

The outlet end 42 of the nozzle is shaped to project mixed air and water at considerable force from the chamber 41 into the pool of water into which the fitting feeds. Since the cylindrical plug valve 25 is all in one piece, and the annular air opening 40 is fixed in dimensions, axial movement of the valve 25 only adjusts water flow through the water inlets 29.

The spherical portion 21 with the correspondingly shaped portion 42 of nozzle socket 9 constitutes a ball joint that permits angular positioning of the nozzle to the extent permitted by the width of the socket 9 at the outlet end. The fitting is accordingly adjustable for flow, and fully directional.

Attachment of the fitting to the wall of the pool is by way of the threaded bulk head fitting 50 and the gasket 51. The fitting is simply inserted in the aperture 52 through the spa, tank or pool wall, and then held in place against the wall by the bulk head fitting 50, which engages threads in the outer socket 53 of the hydrotherapy fitting.

At the same time, the jet nozzle assembly 10 can be removed from the socket without removal of the fitting itself. All that is necessary is to remove the lock ring 17, whereupon the seal ring 19 is released, and the nozzle housing 20 and accompanying assembly 10 can then be withdrawn. Reassembly is in reverse order, with the seal rings 15, 19 being placed in position before insertion and tightening of the lock ring.

Figure 4A:
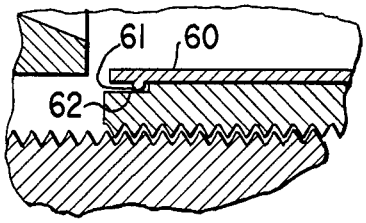
FIG. 4A is a detail view of the snap fitting portion of the liner shown in FIG. 4.
Figure 4:
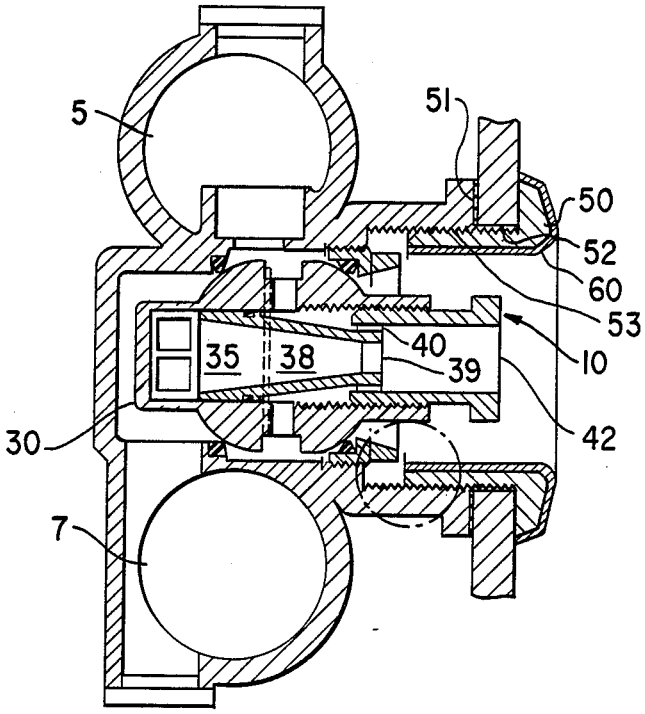
FIG. 4 represents a cross-sectional view of another embodiment of hydrotherapy fitting assembly according to the invention, similar to that of FIGS. 1 to 3 and including a liner for the nozzle of the housing.

The embodiment shown in FIG. 4 is identical to that shown in FIGS. 1 to 3 except for the liner, and consequently like numbers are used for like parts, and the description of the fitting assembly need not be repeated.

As seen in FIG. 4, the liner 60, which can be of stainless steel or inert plastic fits over the threaded bulkhead fitting 50, and is provided with a projecting peripheral lip 61 which fits into the recess 62 in the threaded bulkhead fitting 50, when the liner has been pushed all the way into the central aperture of the bulkhead fitting. The liner snaps out as well as in, and is readily removed by a strong pull.

The hydrotherapy fitting assembly of the invention is useful in all types of hydrotherapy units, including spas, pool and tanks, and can be made to fit in conventional recesses provided in such fittings for such devices Having regard to the foregoing disclosure, the following is claimed as inventive and patentable embodiments thereof:

1. A hydrotherapy fitting assembly comprising, in combination:

(1) a housing having:
  (a) a water inlet;
  (b) an air inlet; and
  (c) an axial socket for reception of a nozzle, the socket being in fluid flow connection with the water inlet and the air inlet for axial water flow in the socket to the nozzle; the socket having cylindrical outer and inner end portions and an enlarged intermediate portion constituting a circumferential recess;

(2) a nozzle in the socket, receiving the axial flow of water in the socket from the water inlet and air from the air inlet, and projecting them in admixture from the housing as a jet stream;

(3) the nozzle comprising two pieces threadably and fixedly linked together for pivoting and rotating movement together in the socket:
  (a) a cylindrical housing piece defining a central chamber having a cylindrical side wall and a closed end wall constituting a valve seat, and a plurality of water inlets extending through the side wall adjacent the closed end wall and constraining water flow therethrough in a direction at an angle to the axial flow in the axial socket; and at least one air inlet extending through the side wall at a central portion thereof; and
  (b) a cylindrical plug valve piece having an axial water inlet at one end and an axial water outlet at the other end, threadably mounted in the central chamber of the cylindrical housing piece, and movable axially on the threads in the central chamber of the cylindrical housing between limiting positions extending across and closing off the side water inlets, and fully exposing and opening the side water inlets, with intermediate positions partially exposing and opening the side water inlets; and leaving the air inlet exposed and open in both limiting positions of the valve;

(i) the cylindrical plug valve having a valve portion having solid cylindrical side walls enclosing a through axial passage with an axial inlet at one end, for entry of a flow of water from the side water inlets into the axial inlet in a flow volume according to the exposure of the side water inlets in the open positions of the valve, and constraining such flow in an axial direction, and in the closed position of the valve when against the end wall valve seat closing off the axial inlet; and an axial aspirating water outlet adjacent the air inlet at the other end; the side wall water inlets in the cylindrical housing in cooperation with the axial socket and the axial inlet and axial passage in the cylindrical plug valve constraining water flow therethrough first in an axial direction, then in a direction at an angle thereto, and then again an axial direction, and thereby in an S-curved path;

(ii) the cylindrical plug valve piece having a nozzle portion comprising:

(c) an axial air inlet at the outer periphery of the axial water outlet;

(d) an axial water inlet in flow communication with the aspirating water outlet of the valve portion;

(e) an axial nozzle mixing chamber receiving air from the axial air inlet and water from the axial aspirating water outlet of the valve portion; and (f) a jet nozzle defining the axial water jet outlet of the plug valve piece and projecting mixed air and water from the nozzle mixing chamber;

(4) the cylindrical housing piece having an outside wall that is cylindrical at each end and spherical intermediate the ends, with a circumferential recess centrally of the spherical portion, and with the air inlet opening into the recess, the housing being pivotable and rotatable in the socket with the spherical portion in the recess of the socket, for angular and rotated movement of the nozzle among a plurality of positions, and so direct flow through the nozzle.

2. A hydrotherapy fitting assembly according to claim 1, in which the axial air inlet of the nozzle portion of the cylindrical plug valve annularly surrounds the axial water outlet of the cylindrical plug valve.

3. A hydrotherapy fitting assembly according to claim 1, comprising a removable lining held in a press fit in the housing socket receiving the nozzle.

* * * * *